US008490702B2

(12) United States Patent
Stromquist et al.

(10) Patent No.: US 8,490,702 B2
(45) Date of Patent: Jul. 23, 2013

(54) DOWNHOLE TOOL ASSEMBLY WITH DEBRIS RELIEF, AND METHOD FOR USING SAME

(75) Inventors: Marty Stromquist, Calgary (CA); Donald Getzlaf, Calgary (CA); Robert Nipper, Spring, TX (US)

(73) Assignee: NCS Oilfield Services Canada Inc. (CA)

( * ) Notice: Subject to any disclaimer, the term of this patent is extended or adjusted under 35 U.S.C. 154(b) by 593 days.

(21) Appl. No.: 12/708,709

(22) Filed: Feb. 19, 2010

(65) Prior Publication Data

US 2011/0198082 A1 Aug. 18, 2011

(30) Foreign Application Priority Data

Feb. 18, 2010 (CA) ..... 2693676

(51) Int. Cl.

| | |
|---|---|
| ***E21B 29/02*** | (2006.01) |
| ***E21B 43/114*** | (2006.01) |
| ***E21B 23/02*** | (2006.01) |
| ***E21B 33/124*** | (2006.01) |

(52) U.S. Cl.
USPC ..... 166/298; 166/55; 166/240; 166/177.5

(58) Field of Classification Search
USPC ..... 166/171, 179, 180, 237, 238, 240, 166/311, 373, 316, 332.7, 332.1, 298, 55, 166/55.1, 177.5, 66, 250.01
See application file for complete search history.

(56) References Cited

U.S. PATENT DOCUMENTS

| | | | | |
|---|---|---|---|---|
| 2,034,768 | A * | 3/1936 | O'Neill | 166/298 |
| 2,212,743 | A | 8/1940 | Kremming | |
| 2,458,433 | A | 1/1949 | Artebury et al. | |
| 2,624,409 | A * | 1/1953 | O'Neill | 166/55 |
| 2,670,218 | A | 2/1954 | Rokar | |
| 2,683,432 | A | 7/1954 | Schanz | |
| 2,766,014 | A | 10/1956 | Hanson | |
| 2,769,497 | A | 11/1956 | Keisle, Jr. | |
| 2,881,839 | A | 4/1959 | Wright et al. | |
| 2,906,339 | A | 9/1959 | Griffin | |
| 2,929,713 | A | 3/1960 | Bickoff et al. | |
| 2,929,714 | A | 3/1960 | Lienhard | |
| 2,969,841 | A | 1/1961 | Thomas | |
| 2,986,214 | A | 5/1961 | Wiseman, Jr. et al. | |

(Continued)

FOREIGN PATENT DOCUMENTS

| | | |
|---|---|---|
| CA | 1081608 | 7/1980 |
| CA | 1147643 | 6/1983 |

(Continued)

OTHER PUBLICATIONS

International Search Report for application PCT/CA2011/001167 dated Feb. 8, 2012.

(Continued)

*Primary Examiner* — Kenneth L Thompson
(74) *Attorney, Agent, or Firm* — Wong, Cabello, Lutsch, Rutherford & Brucculeri, L.L.P.

(57) ABSTRACT

A tool assembly and method for completing a well are provided. The tool includes debris relief features that enable use in solids-laden environments, for example in the presence of sand. Forward and reverse circulation pathways to the isolated interval are present to allow clearing of debris from the wellbore annulus while the sealing device remains set against the wellbore.

22 Claims, 10 Drawing Sheets

U.S. PATENT DOCUMENTS 3,032,111 A 5/1962 Corley
3,118,501 A 1/1964 Kenley
3,228,210 A 1/1966 Farmer
3,273,649 A 9/1966 Tamplen
3,381,749 A 5/1968 Chenoweth
3,417,827 A 12/1968 Smith et al.
3,430,701 A 3/1969 Canada
3,433,305 A 3/1969 Bell
3,447,607 A * 6/1969 Harris et al. ..... 166/278
3,463,248 A 8/1969 Chaffee et al.
3,507,325 A 4/1970 Scott
3,648,777 A 3/1972 Arterbury et al.
3,845,818 A 11/1974 Denton
3,878,889 A 4/1975 Seabourn
3,895,678 A 7/1975 Wright et al.
4,047,569 A 9/1977 Tagirov et al.
4,071,096 A 1/1978 Dines
4,194,561 A 3/1980 Stokley et al.
4,257,484 A 3/1981 Whitley et al.
4,287,952 A 9/1981 Erbstoesser
4,312,406 A 1/1982 McLaurin et al.
4,346,761 A * 8/1982 Skinner et al. ..... 166/206
4,421,182 A 12/1983 Moody et al.
4,427,060 A 1/1984 Villers
4,427,070 A 1/1984 O'Brien
4,470,464 A 9/1984 Baidenko et al.
4,501,331 A 2/1985 Brieger
RE31,842 E 3/1985 Weltz
4,523,643 A 6/1985 McGlothen
4,619,323 A 10/1986 Gidley
4,637,468 A 1/1987 Derrick
4,733,723 A 3/1988 Callegari, Sr.
4,804,042 A 2/1989 Knight
4,834,183 A 5/1989 Vinzant et al.
4,881,599 A 11/1989 Franco et al.
4,889,199 A 12/1989 Lee
4,917,187 A 4/1990 Burns et al.
4,940,094 A 7/1990 Lessi et al.
4,953,617 A 9/1990 Ross et al.
5,033,551 A 7/1991 Grantom
5,117,910 A 6/1992 Brandell et al.
5,127,472 A 7/1992 Watson et al.
5,314,015 A 5/1994 Streich
5,316,086 A 5/1994 DeMoss
5,318,123 A 6/1994 Venditto et al.
5,353,875 A 10/1994 Schultz et al.
5,358,048 A 10/1994 Brooks
5,417,291 A 5/1995 Leising
5,435,395 A 7/1995 Connell
5,472,049 A 12/1995 Chaffee et al.
5,474,130 A 12/1995 Davis
5,499,687 A 3/1996 Lee
5,513,703 A * 5/1996 Mills et al. ..... 166/55.1
5,638,904 A 6/1997 Misselbrook et al.
5,704,426 A 1/1998 Rytlewski et al.
5,711,372 A 1/1998 Stokley
5,755,286 A 5/1998 Ebinger
5,765,642 A 6/1998 Surjaatmadja
5,799,732 A 9/1998 Gonzalez et al.
5,813,456 A 9/1998 Milner
5,842,521 A 12/1998 Tetzlaff et al.
5,890,536 A 4/1999 Nierode et al.
5,934,377 A 8/1999 Savage
5,947,200 A 9/1999 Montgomery
5,954,133 A 9/1999 Ross
6,024,173 A 2/2000 Patel et al.
6,116,343 A 9/2000 Van Petegem et al.
6,142,231 A 11/2000 Myers, Jr. et al.
6,186,227 B1 2/2001 Vaynshteyn et al.
6,244,351 B1 6/2001 Patel
6,273,195 B1 8/2001 Hauck et al.
6,286,598 B1 9/2001 van Petegem et al.
6,286,660 B1 9/2001 Kalm
6,289,990 B1 9/2001 Dillon et al.
6,293,346 B1 9/2001 Patel
6,364,017 B1 4/2002 Stout et al.
6,394,184 B2 5/2002 Tolman et al.
6,427,773 B1 8/2002 Albers
6,460,619 B1 10/2002 Braithwaite et al.
6,474,419 B2 11/2002 Maier et al.
6,491,098 B1 12/2002 Dallas
6,497,290 B1 12/2002 Misselbrook et al.
6,513,595 B1 2/2003 Freiheit et al.
6,516,595 B2 2/2003 Rhody et al.
6,520,255 B2 2/2003 Tolman et al.
6,543,538 B2 4/2003 Tolman et al.
6,575,247 B2 6/2003 Tolman et al.
6,672,405 B2 1/2004 Tolman et al.
6,675,898 B2 1/2004 Staudt
6,695,057 B2 * 2/2004 Ingram et al. ..... 166/308.1
6,732,793 B1 5/2004 Lee
6,763,892 B2 7/2004 Kaszuba
6,772,847 B2 8/2004 Rae et al.
6,810,958 B2 11/2004 Szarka et al.
6,840,323 B2 1/2005 Fenton
6,907,936 B2 6/2005 Fehr et al.
6,915,856 B2 7/2005 Gentry et al.
6,923,255 B2 8/2005 Lee
6,949,491 B2 9/2005 Cooke
6,957,701 B2 10/2005 Tolman et al.
7,051,812 B2 5/2006 McKee et al.
7,059,407 B2 6/2006 Tolman et al.
7,066,264 B2 * 6/2006 Bissonnette et al. ..... 166/305.1
7,066,266 B2 6/2006 Wilkinson
7,104,652 B2 9/2006 Kojima
7,108,067 B2 9/2006 Themig et al.
7,121,337 B2 10/2006 Cook et al.
7,134,505 B2 11/2006 Fehr et al.
7,165,611 B2 1/2007 Jones
7,191,830 B2 3/2007 McVay et al.
7,213,654 B2 5/2007 Plucheck et al.
7,225,869 B2 6/2007 Willett et al.
7,278,486 B2 10/2007 Alba et al.
7,284,619 B2 10/2007 Stokley et al.
7,287,596 B2 10/2007 Frazier et al.
7,325,617 B2 2/2008 Murray
7,343,975 B2 3/2008 Surjaatmadja et al.
7,347,288 B2 3/2008 Lee
7,357,151 B2 4/2008 Lonnes
7,416,029 B2 8/2008 Telfer et al.
7,441,595 B2 * 10/2008 Jelsma ..... 166/117.7
7,467,778 B2 12/2008 Lonnes
7,472,746 B2 1/2009 Maier
7,510,017 B2 * 3/2009 Howell et al. ..... 166/387
7,516,792 B2 4/2009 Lonnes et al.
7,520,333 B2 4/2009 Turner et al.
7,556,102 B2 7/2009 Gomez
7,650,947 B2 1/2010 Henke et al.
7,789,163 B2 9/2010 Kratochvil et al.
7,849,924 B2 * 12/2010 Surjaatmadja et al. ..... 166/298
7,896,082 B2 3/2011 Lake et al.
7,913,770 B2 3/2011 Schramm et al.
8,016,032 B2 9/2011 Mandrell et al.
8,066,074 B2 11/2011 Maskos et al.
D657,807 S 4/2012 Frazeir
8,210,267 B2 7/2012 Avant
2002/0162660 A1 11/2002 Depiak et al.
2003/0121663 A1 7/2003 Weng et al.
2004/0206504 A1 10/2004 Rosato
2005/0056429 A1 3/2005 Du et al.
2005/0072527 A1 4/2005 Gunji et al.
2005/0072577 A1 4/2005 Freeman
2005/0150661 A1 7/2005 Kenison et al.
2005/0178551 A1 8/2005 Tolman et al.
2005/0236154 A1 10/2005 Tudor et al.
2006/0000620 A1 1/2006 Hamilton
2006/0108117 A1 5/2006 Telfer
2006/0124310 A1 6/2006 Lopez de Cardenas et al.
2006/0180319 A1 8/2006 Lucas et al.
2006/0243456 A1 11/2006 Faul
2007/0062690 A1 3/2007 Witcher
2007/0272410 A1 11/2007 Hromas et al.
2007/0272411 A1 11/2007 Lopez de Cardenas et al.
2008/0066917 A1 3/2008 Lehr et al.
2008/0142219 A1 * 6/2008 Steele et al. ..... 166/281
2008/0179060 A1 7/2008 Surjaatmadja et al.
2008/0202755 A1 8/2008 Henke et al.

| | | | | |
|---|---|---|---|---|
| 2008/0314591 | A1* | 12/2008 | Hales et al. | 166/285 |
| 2008/0314600 | A1 | 12/2008 | Howard et al. | |
| 2009/0044944 | A1 | 2/2009 | Murray et al. | |
| 2009/0107680 | A1* | 4/2009 | Surjaatmadja | 166/308.1 |
| 2009/0159299 | A1 | 6/2009 | Kratochvil et al. | |
| 2009/0242211 | A1* | 10/2009 | Fagley et al. | 166/374 |
| 2009/0294124 | A1 | 12/2009 | Patel | |
| 2010/0108323 | A1 | 5/2010 | Wilkin | |
| 2011/0061856 | A1 | 3/2011 | Kellner et al. | |
| 2011/0174491 | A1 | 7/2011 | Ravensbergen et al. | |
| 2011/0198082 | A1 | 8/2011 | Stromquist et al. | |
| 2011/0290486 | A1 | 12/2011 | Howard et al. | |
| 2011/0308817 | A1 | 12/2011 | Ravensbergen | |
| 2012/0055671 | A1 | 3/2012 | Stromquist et al. | |
| 2012/0061103 | A1 | 3/2012 | Hurtado et al. | |
| 2012/0086802 | A1 | 4/2012 | Eng et al. | |
| 2012/0090847 | A1 | 4/2012 | Getzlaf et al. | |
| 2012/0125619 | A1 | 5/2012 | Wood et al. | |
| 2012/0186802 | A1 | 7/2012 | Howard et al. | |

FOREIGN PATENT DOCUMENTS

| | | | |
|---|---|---|---|
| CA | 1163554 | | 3/1984 |
| CA | 1210686 | | 9/1986 |
| CA | 1298779 | | 4/1992 |
| CA | 2121636 | | 10/1994 |
| CA | 2133818 | A1 | 4/1995 |
| CA | 2133818 | A1 | 4/1995 |
| CA | 2212743 | | 6/1997 |
| CA | 2381360 | A1 | 1/2001 |
| CA | 2497463 | A1 | 3/2004 |
| CA | 2458433 | A1 | 8/2004 |
| CA | 2167491 | A1 | 2/2005 |
| CA | 2167491 | C | 2/2005 |
| CA | 2249432 | A1 | 9/2005 |
| CA | 2249432 | C | 9/2005 |
| CA | 2320949 | | 5/2006 |
| CA | 2618277 | A1 | 3/2007 |
| CA | 2618277 | A1 | 2/2008 |
| CA | 2416040 | A1 | 9/2008 |
| CA | 2416040 | C | 9/2008 |
| CA | 2639341 | | 3/2009 |
| CA | 2701700 | A1 | 4/2009 |
| CA | 2397460 | A1 | 7/2009 |
| CA | 2397460 | C | 7/2009 |
| CA | 2743164 | A1 | 5/2010 |
| CA | 2693676 | A1 | 7/2010 |
| CA | 2749636 | A1 | 7/2010 |
| CA | 2711329 | A1 | 1/2011 |
| CA | 2730695 | A1 | 4/2011 |
| CA | 2738907 | A1 | 7/2011 |
| CA | 2766026 | A1 | 7/2011 |
| CA | 2781721 | A1 | 9/2012 |
| EP | 589687 | A2 | 3/1994 |
| EP | 2105577 | A1 | 9/2009 |
| GB | 2356879 | A | 6/2001 |
| GB | 2403968 | A | 1/2005 |
| GB | 2403968 | A | 1/2005 |
| SU | 926238 | A1 | 5/1982 |
| WO | 9625583 | A1 | 8/1996 |
| WO | WO-9625583 | A1 | 8/1996 |
| WO | 9735093 | A1 | 9/1997 |
| WO | WO-9735093 | A1 | 9/1997 |
| WO | 02068793 | A1 | 9/2002 |
| WO | 03015025 | A2 | 2/2003 |
| WO | 2008091345 | A1 | 7/2008 |
| WO | 2008093047 | A1 | 8/2008 |
| WO | WO-2008093047 | A1 | 8/2008 |
| WO | 2009068302 | A2 | 6/2009 |
| WO | WO-2009068302 | A2 | 6/2009 |
| WO | WO-2011116207 | A1 | 9/2011 |
| WO | 2011133810 | A2 | 10/2011 |
| WO | 2012027831 | A1 | 3/2012 |
| WO | 2012051705 | A1 | 4/2012 |
| WO | 2012014574 | A2 | 8/2012 |

OTHER PUBLICATIONS

Canadian Office Action for Serial No. 2,693,676 dated Jun. 16, 2011.
Canadian Office Action for Serial No. 2,693,676 dated Oct. 19, 2010.
Publication "Sand Jet Perforating Revisited", J.S. Cobbett, SPE Drills & Completion 14(1), Mar. 1999, pp. 28-33.
"Sand Jet Perforating Revisited", SPE Drill & Completion, vol. 14, No. 1 Mar. 1999, J.S. Cobbett, pp. 28-33.
"Tubing-Conveyed Perforating With Hydraulic Set Packers and a New High-Pressure Retrievable Hydraulic Packer" SPE 13372, Hailey and Donovan 1984.
"Advances in Sand Jet Perforating", SPE 123569, Dotson, Far and Findley, 2009, pp. 1-7.
"High-Pressure/High-Temperature Coiled Tubing Casing Collar Locator Provides Accurate Depth Control for Single-Trip Perforating" SPE 60698, Connell et al, 2000, pp. 1-9.
"Investigation of Abrasive-Laden-Fluid Method for Perforation and Fracture Initiation" Journal of Petroleum Technology, Pittman, Harriman and St. John, 1961, pp. 489-495.
"Sand Jet Perforating Revisited" SPE 39597, Cobbett 1998, pp. 703-715.
"Single-Trip Completion Concept Replaces Multiple Packers and Sliding Sleeves in Selective Multi-Zone Production and Stimulation Operations" SPE 29539, Coon and Murray 1995, pp. 911-915.
"Z-Frac Straddle Packer" brochure information (3 pages).
Innicor Tool Information (3 pages).
Cobbett, J.S. (1999). Sand jet perforating revisited. *SPE Drill & Completion*, 14(1), 28-33.
Baker Oil Tools Catalogue 2002.
Tools International Corporation Catalogue 2008.
International Search Report for Application PCT/CA2011/000988 mailed Oct. 17, 2011.
Office Action dated Jan. 17, 2011 from Canadian Intellectual Property Office for Serial No. 2,713,611.
Accuracy and Reliability of Coiled Tubing Depth Measurement (SPE38422) Pessin, J-L, et al. 1997.
Development of a Wireless Coiled Tubing Collar Locator (SPE54327) Connell, Michael L. et al., 1999.

* cited by examiner

DOWNHOLE TOOL ASSEMBLY WITH DEBRIS RELIEF, AND METHOD FOR USING SAME

FIELD OF THE INVENTION

The present invention relates generally to oil and gas well completion. More particularly, the present invention relates to a tool string for use in perforating and stimulating multiple intervals of a wellbore in the presence of flowable solids, such as sand.

BACKGROUND OF THE INVENTION

Tools for use downhole in the completion of a wellbore are generally well known. For example, perforation devices are commonly deployed downhole on wireline, slickline, cable, or on tubing string, and sealing devices such as bridge plugs and straddle packers are commonly used to isolate portions of the wellbore during fluid treatment of the wellbore. As such, tools are exposed to varying conditions during use, improvements have evolved over time to address problems typically encountered downhole.

Recently, tool assemblies for performing multiple functions in a single trip downhole have been developed, greatly reducing the cost of well completion operations. For example, CA 2,397,460 describes a bottom hole assembly for use in the sequential perforation and treatment of multiple wellbore intervals in a single trip downhole. Perforation with an explosive charge followed by sealing of the wellbore and application of treatment to the wellbore annulus is described. No active debris relief is described to maintain tool functionality in the presence of debris/solids, such as sand. Accordingly, the use of this tool in the presence of flowable solids would be associated with significant risk of debris-related tool malfunction, jamming or immobility of the tool assembly, and potential loss of the well if the tool assembly cannot be retrieved.

The use of jet nozzles in cleaning cased wellbores, and fracturing uncased wellbores, has been previously described in detail. Notably, CA 2,621,572 describes the deployment of a fluid jetting device above an inflatable packer. This type of packer provides minimal sealing against the uncased wellbore, allowing the assembly to travel up or downhole while the packers are inflated. This system is not suitable for use in perforation of a cased wellbore or in debris-laden environments, due in part to the imperfect seal provided by the inflatable packers, and the inability to clear solids that may settle over the packer and/or may block the jet nozzles.

Use of any sealing device in the presence of significant amounts of sand or other solids increases the risk of tool malfunction. Further, the tool may be lost downhole should a solids blockage occur during treatment, or when the formation expels solids upon release of hydraulic pressure in the wellbore annulus when treatment is complete. Moreover, when jetting abrasive fluid to perforate a wellbore casing, the prior art does not provide a suitable method for delivering clear fluid to the perforations/removing settled solids from the perforations in the event of a solids blockage. Typical completion assemblies have many moving components for actuating various downhole functions, and the presence of sand or other solids within these actuation mechanisms would risk jamming these mechanisms, causing a malfunction or permanent damage to the tool or well. Correcting such a situation is costly, and poses significant delays in the completion of the well. Accordingly, well operators, fracturing companies, and tool suppliers/service providers are typically very cautious in their use of sand and other flowable solids downhole. The addition of further components to the assembly adds further risk of solids blockages in tool actuation, and during travel of the tool from one segment of the wellbore to another, further risking damage to the assembly. Increasing the number of segments to be perforated and treated in a single trip also typically increases the size of the assembly, as additional perforating charges are required. Excessive assembly lengths become cumbersome to deploy, and increase the difficulty in removal of the assembly from the wellbore in the presence of flowable solids.

SUMMARY OF THE INVENTION

In a first aspect, there is provided an assembly for deployment within a wellbore, the assembly comprising: a perforation device; a resettable sealing device operatively assembled with the perforation device for deployment on tubing string; a sliding member operatively associated with the tubing string, for use in actuation of the resettable sealing device; and a debris relief passageway operatively associated with the sliding member, for use in discharge of settled debris about the sliding member.

In one embodiment, the wellbore is a cased wellbore, and the sliding member is a mechanical casing collar locator having outwardly biased locating members for sliding against the casing to verify the downhole location of the tool assembly prior to actuation of the sealing device. In a further embodiment, the debris relief passageway may comprise one or more apertures through the locating members to allow passage of fluid and debris through the locating members, thereby preventing accumulation of settled debris against the locating members.

In another embodiment, the sliding member is an auto-J profile slidable against a pin for actuation of the sealing member. The debris relief passageway may comprise one or more debris ports through the J-profile to permit discharge of debris upon slidable movement of the pin within the J-profile. In a further embodiment, the J-slot is sized at least 1/16 inch greater than the pin, to allow debris accumulation and movement within the J-profile without impeding travel of the pin along the J-profile. The pin may be held to the assembly by a clutch ring, and the clutch ring may comprise debris relief passageways to permit discharge of debris from about the pin while the pin slides within the J-profile.

In another embodiment, the sliding member is an equalization valve actuable to open a flowpath within the sealing device, for unseating the sealing device from the wellbore. In a further embodiment, the equalization valve comprises an equalization plug slidable within an equalization valve housing. The equalization plug, in one embodiment, may be actuated by application of force to the tubing string.

In certain embodiments, the perforation device is a fluid jet perforation device assembled above the sealing device. In a further embodiment, the resettable sealing device comprises a compressible sealing element actuated by the sliding of a pin within an auto J profile. The J profile may comprise debris ports for discharging debris upon slidable movement of the pin within the J-profile.

In one embodiment, the J-slot is sized at least 1/16 inches greater (in width and/or depth) than the pin, to allow debris accumulation and movement within the J-profile without impeding travel of the pin along the J-profile.

The pin, in any of the above-mentioned embodiments, may be held to the assembly by a clutch ring comprising debris relief passageways to permit discharge of debris from about the pin while the pin slides within the J-profile.

In another embodiment, the assembly further comprises a mechanical casing collar locator having outwardly biased locating members for sliding against the casing to verify the downhole location of the tool assembly prior to actuation of the sealing device. One or more apertures through the mandrel and/or locating members may be present to allow passage of fluid and debris through the locating members, thereby preventing accumulation of settled debris against the locating members.

In accordance with a second aspect of the invention, there is provided a multi-function valve for use within a downhole assembly deployed on tubing string, the multi-function valve comprising:

- a valve housing having an internal cavity continuous with a length of tubing string and with a lower assembly mandrel, the valve housing further comprising at least one cross flow port, to permit fluid cross flow through the internal cavity;
- a forward flow-stop valve operatively associated with the valve housing, for preventing fluid flow from the tubing string into the valve housing;
- a valve plug slidably disposed within the valve housing for movement between a flow position and a sealed position, the valve plug comprising:
  - an internal fluid flowpath continuous with the forward flow-stop valve and with the cross flow port of the valve housing when the valve plug is in either the sealed or flow position, and,
  - a valve stem for sealing within the lower assembly mandrel when the valve plug is in the sealed position, to prevent fluid communication between the internal cavity of the valve housing and the lower assembly mandrel.

In one embodiment, the valve plug is operationally coupled to the tubing string so as to be actuable upon application of force to the tubing string.

In accordance with a third aspect of the invention, there is provided a method for abrasive perforation and treatment of a formation intersected by a cased wellbore, the method comprising the steps of:

- deploying a tool assembly within the wellbore on tubing string, the tool assembly comprising a fluid jet perforation device and a sealing device;
- setting the sealing device against the wellbore;
- jetting abrasive fluid from the perforation device to perforate the wellbore casing; and
- circulating treatment fluid down the wellbore annulus to treat the perforations and to flow solids through at least a portion of the tool assembly.

In one embodiment, the sealing device comprises a compressible sealing element actuated by application of force to the tubing string. In a further embodiment, the sealing device is actuated by sliding of a pin within an auto-J profile in response to an application of force to the tubing string.

In an embodiment, the abrasive fluid comprises sand. The treatment fluid may comprise flowable solids.

In an embodiment, the method comprises the step of delivering fluid to the tubing string while treatment is delivered down the wellbore annulus.

In various embodiments, the method further comprises the steps of: monitoring the rate and pressure of fluid delivery down the tubing string; monitoring the rate and pressure of fluid delivery down the wellbore annulus; and estimating the fracture extension pressure during treatment.

In an embodiment, the method further comprises the step of reverse circulating fluid from the wellbore annulus to surface through the tubing string.

In another embodiment, the method further comprises the step of equalizing pressure above and below the sealing device by applying a force to the tubing string to actuate an equalization valve.

In another embodiment, the method further comprises the step of equalizing pressure between the tubing string and wellbore annulus without unseating the sealing device from the wellbore casing.

In another embodiment, the method further comprises the step of moving the tool assembly to another wellbore interval and repeating any or all of the above steps.

In another embodiment, the method further comprises the step of opening an equalization passage from beneath the sealing device to the wellbore annulus above the sealing device.

In accordance with a fourth aspect, there is provided a mechanical casing collar locator for use within a downhole tool assembly, the mechanical casing collar locator comprising outwardly biased locating members for sliding against the casing to verify the downhole location of the tool assembly prior to actuation of the sealing device.

In accordance with one embodiment, the collar locator comprises one or more apertures through the locating members to allow passage of fluid and debris through the locating members, thereby preventing accumulation of settled debris against the locating members.

In accordance with a fifth aspect, there is provided an actuation device for use with a resettable downhole tool in the presence of flowable solids, the actuation device comprising a pin slidable within an auto J profile, wherein the auto J profile comprises debris ports for discharging debris upon slidable movement of the pin within the J-profile.

In one embodiment, the J-slot is sized at least 1/16 inch greater than the pin, to allow debris accumulation and movement within the J-profile without impeding travel of the pin along the J-profile. The pin may be held to the assembly by a clutch ring comprising debris relief passageways to permit discharge of debris from about the pin while the pin slides within the J-profile.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

Figure 3:
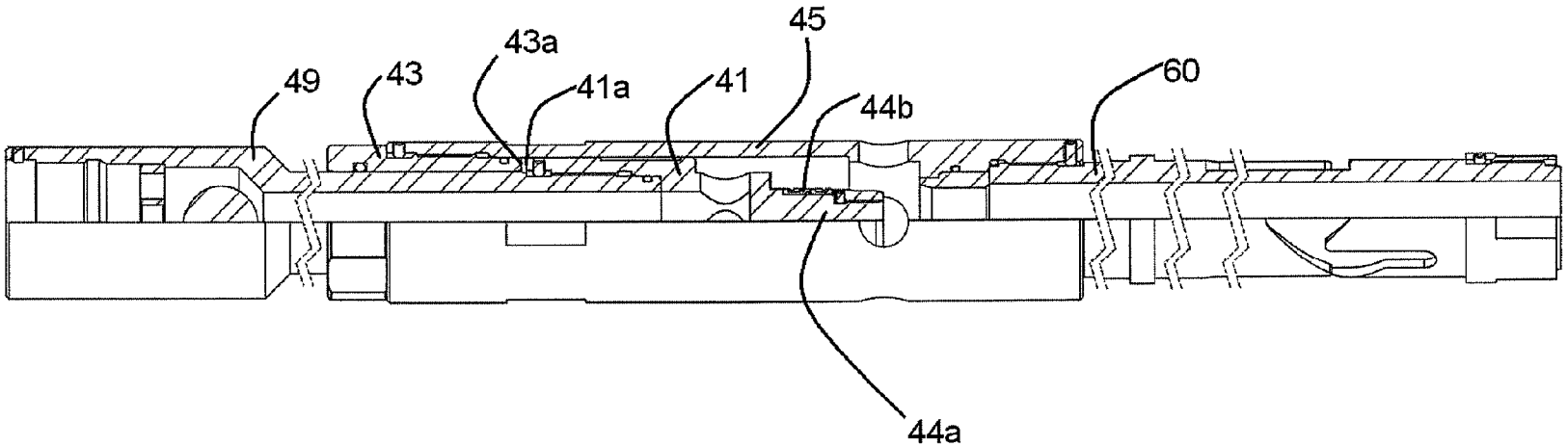
FIG. 3 is a cross sectional view of an equalization device in accordance with one embodiment.
Figure 5:
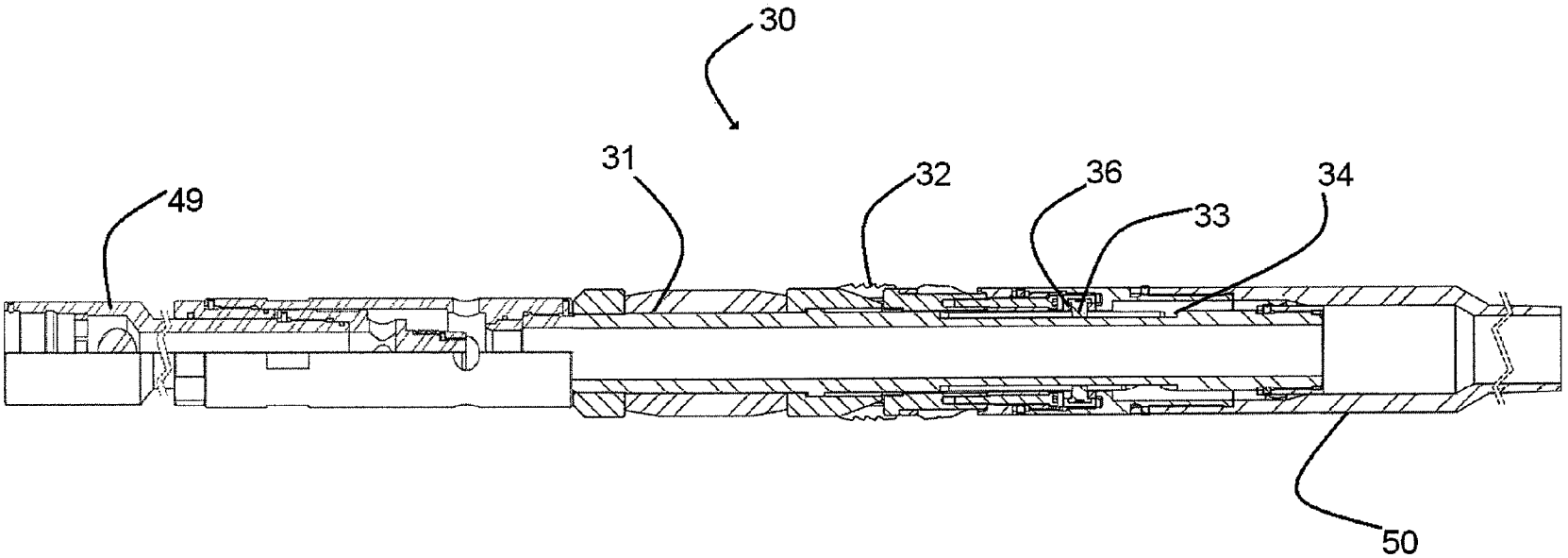
Figure 6A:
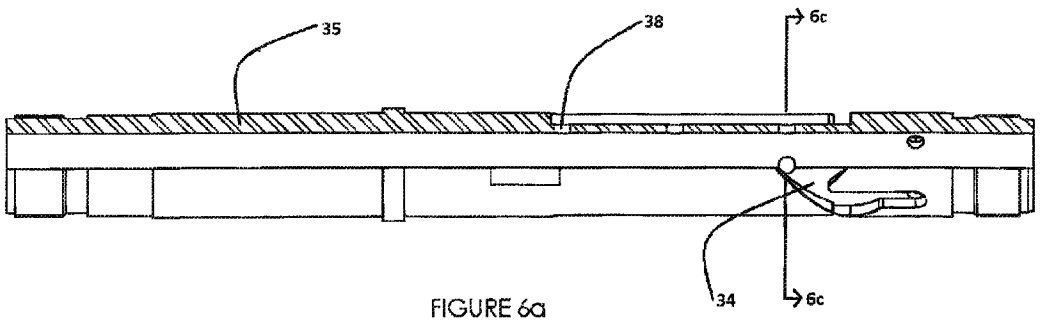
Figure 6B:
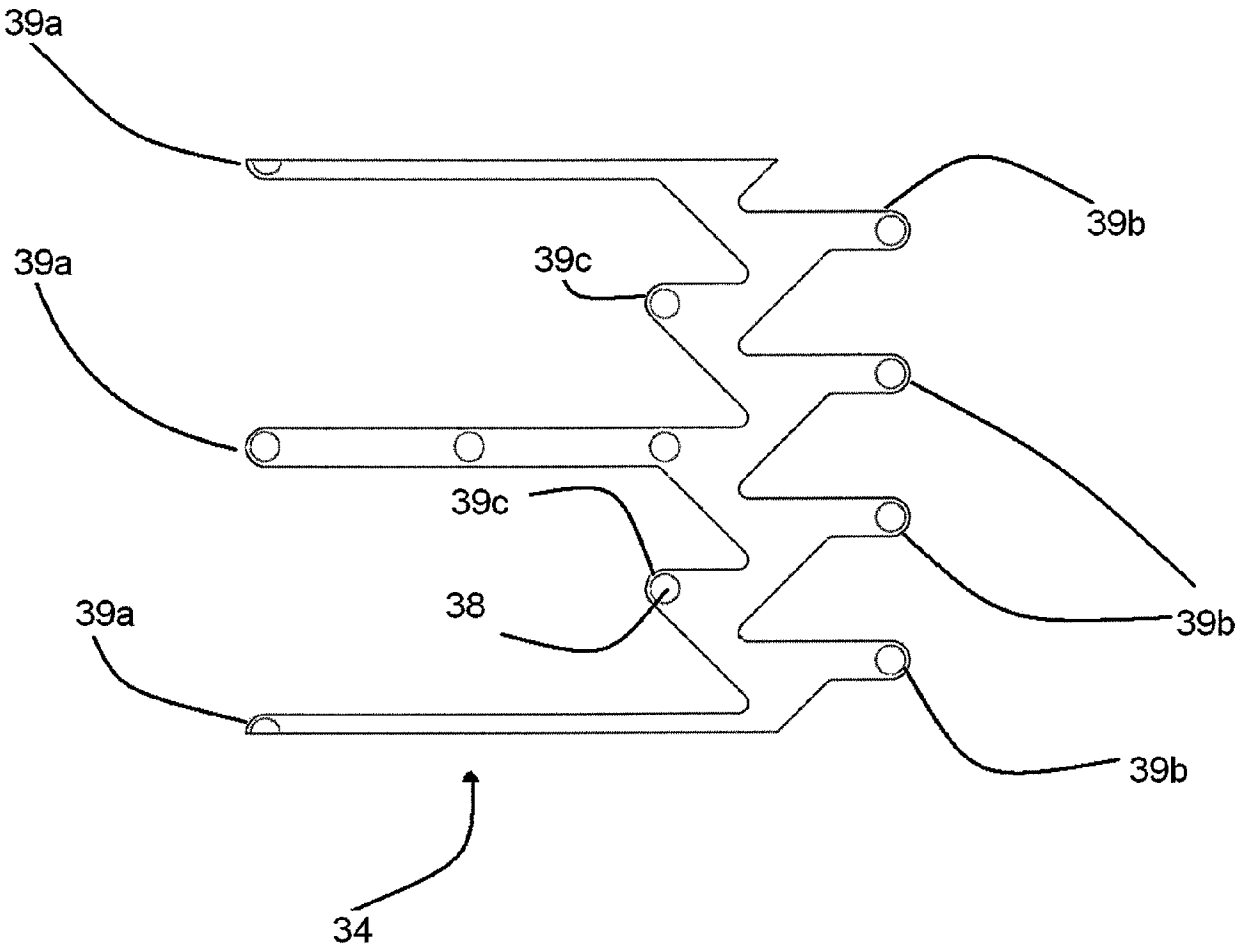
Figure 6D:
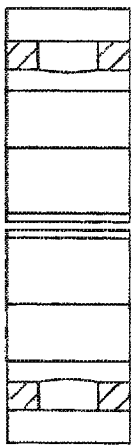
Figure 6C:
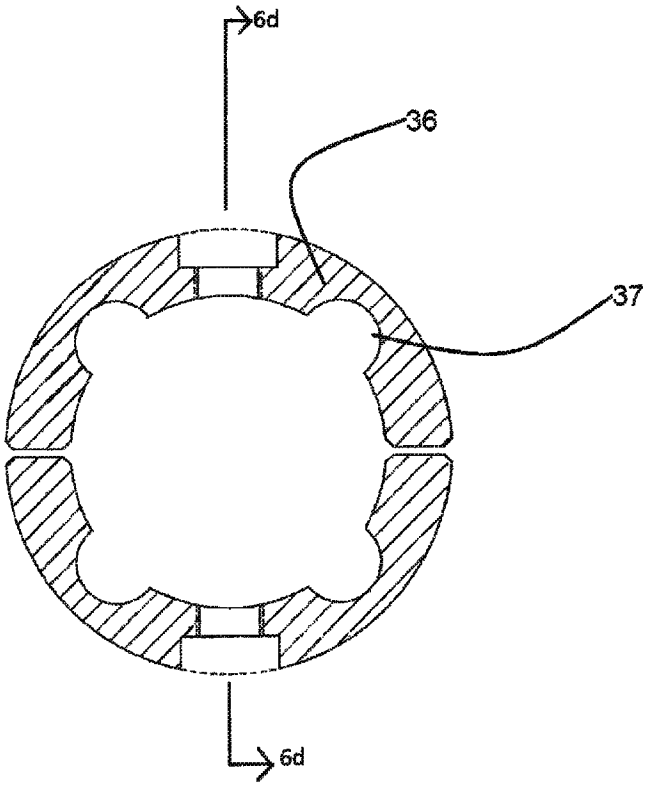
Figure 7:
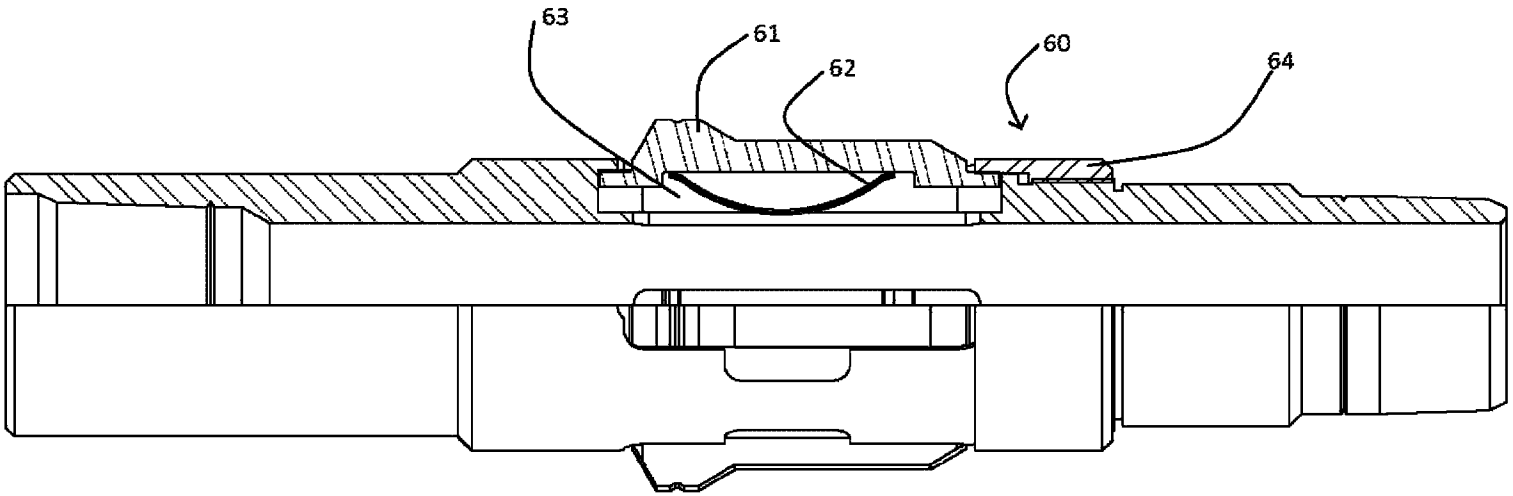

FIG. **4*a* is a cross sectional view of the equalization plug 41 shown in FIG. 3**;

FIG. **4*b* is a cross sectional of the equalization valve housing 45 shown in FIG. 3**;

FIG. 5 is a cross sectional view of a portion of a tool assembly in accordance with one embodiment, in which the equalization device of FIG. 3 is shown assembled with a sealing device 30;

FIG. **6*a* is a perspective and partial cutaway view of the sealing assembly mandrel 35 shown in FIG. 5**;

FIG. 6*b* is a diagram of the J-profile applied to the sealing assembly mandrel shown in FIG. 5;

FIGS. 6*c* and 6*d* are top and side views, respectively, of the clutch ring 36 shown in FIG. 5; and, FIG. 7 is a perspective and partial cutaway view of a mechanical casing collar locator for use within a tool assembly in accordance with one embodiment.

DETAILED DESCRIPTION

Generally, a downhole assembly and method are provided for use in perforating and fracturing multiple intervals of a wellbore without removing the tool string from the wellbore between intervals. This system may generally be used in vertical, horizontal, or branched oil and gas wells having cased wellbores, and could also be adapted for use in an open hole wellbore application.

In the present description, the terms "above/below" and "upper/lower" are used for ease of understanding, and are generally intended to mean the uphole and downhole direction from surface. However, these terms may be inaccurate in certain embodiments depending on the configuration of the wellbore. For example, in a horizontal wellbore one device may not be above another, but instead will be closer (uphole) or further (downhole) from the point of entry into the wellbore. Likewise, the term "surface" is intended to mean the point of entry into the wellbore, that is, the work floor where the assembly is inserted downhole.

Overview

Generally, the assembly may be deployed on tubing string such as jointed pipe, concentric tubing, or coiled tubing. The assembly will typically include at least a perforation device, and a sealing device downhole of the perforating device. Perforating devices are well known, such as guns for activating shaped charges, abrasive fluid jetting, and the like. Various sealing devices for use downhole are also available, such as bridge plugs, friction cups, inflatable packers, and compressible sealing elements. While the present description and drawings are primarily focussed on the combination of abrasive fluid jet perforation and resettable mechanically actuated compressible packers, modifications to the specified devices and the arrangement of the assembly may be made in accordance with the degree of variation and experimentation typical in this art field.

Figure 1:
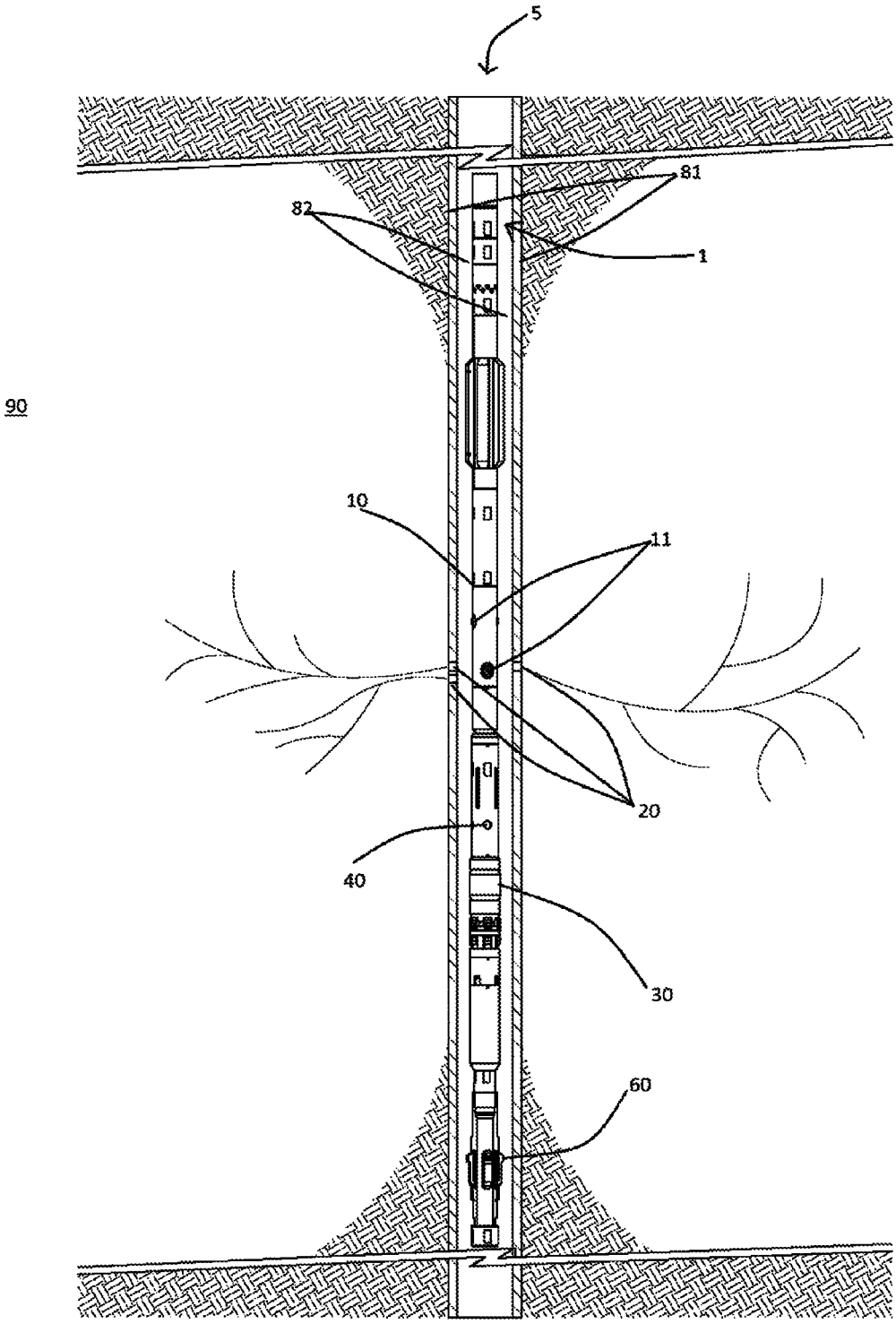
FIG. 1 is a perspective view of a tool assembly deployed within wellbore in accordance with one embodiment, with the wellbore shown in cross section.

With reference to FIG. 1, a fluid jetting device 10 is provided for creating perforations 20 in the casing 81, and a sealing device 30 is provided for use in the isolation and treatment of the perforated interval. The tool string 5 is assembled and deployed downhole on tubing (for example coiled tubing or jointed pipe) to the lowermost interval of interest. The fluid jetting device 10 is then used to perforate the casing 81, providing access to the hydrocarbon-bearing formation 90 surrounding the cased wellbore.

While the sealing device 30 is set against the casing 81 of the wellbore, a fluid treatment (for example a fracturing fluid) is injected down the wellbore annulus 82 from surface under pressure, which enters the formation 90 via the perforations 20, to fracture the formation 90. Once the treatment is complete, the hydraulic pressure in the annulus 82 is slowly dissipated, and the sealing device 30 is released. The tool may then be moved up-hole to the next interval of interest.

As the environment in which the present tool string is used may be sand-laden (due to the formation characteristics, abrasive fluids used in jetting, and/or proppant-laden treatment fluids), there is a significant risk that debris may accumulate within the apertures, slots, chambers, and moving parts of the tool during deployment. For example, jet perforation using abrasive fluid may cause solids to accumulate over the sealing device, if the sealing device is set prior to perforation. Further, when applying a proppant-laden fracturing fluid, proppant and/or formation debris may accumulate over the sealing device, and enter the tool assembly, settling in the moving external and internal workings of the tool. Accordingly, debris relief may incorporated into the tool, as will be described in detail below.

Briefly, both forward and reverse circulation flowpaths between the wellbore annulus and the inner mandrel of the tool string are provided to allow debris to be carried in the forward or reverse direction through the tool string. Further, debris relief features are incorporated into the moving/sliding parts of the tool string to prevent accumulation of sand, proppant, and other debris that might otherwise prevent actuation or retrieval of the tool. Further, the tubing string may be used as a dead leg during treatment down the annulus, to allow pressure monitoring for early detection of adverse events during treatment, to allow prompt action in relieving debris accumulation.

Fluid Jetting Device

In the embodiment shown in the drawings, the perforation device 10 is an abrasive fluid jet assembly, deployed on tubing string (for example coiled tubing or jointed pipe). Such fluid delivery assemblies with jet nozzles are generally known, and have been used previously in well cleaning operations, application of fracturing treatment, and in placing casing perforations. For perforation operations, pressurized abrasive fluid is applied through the tubing, and is forced through jet nozzles 11 to perforate the wellbore.

Figure 2:
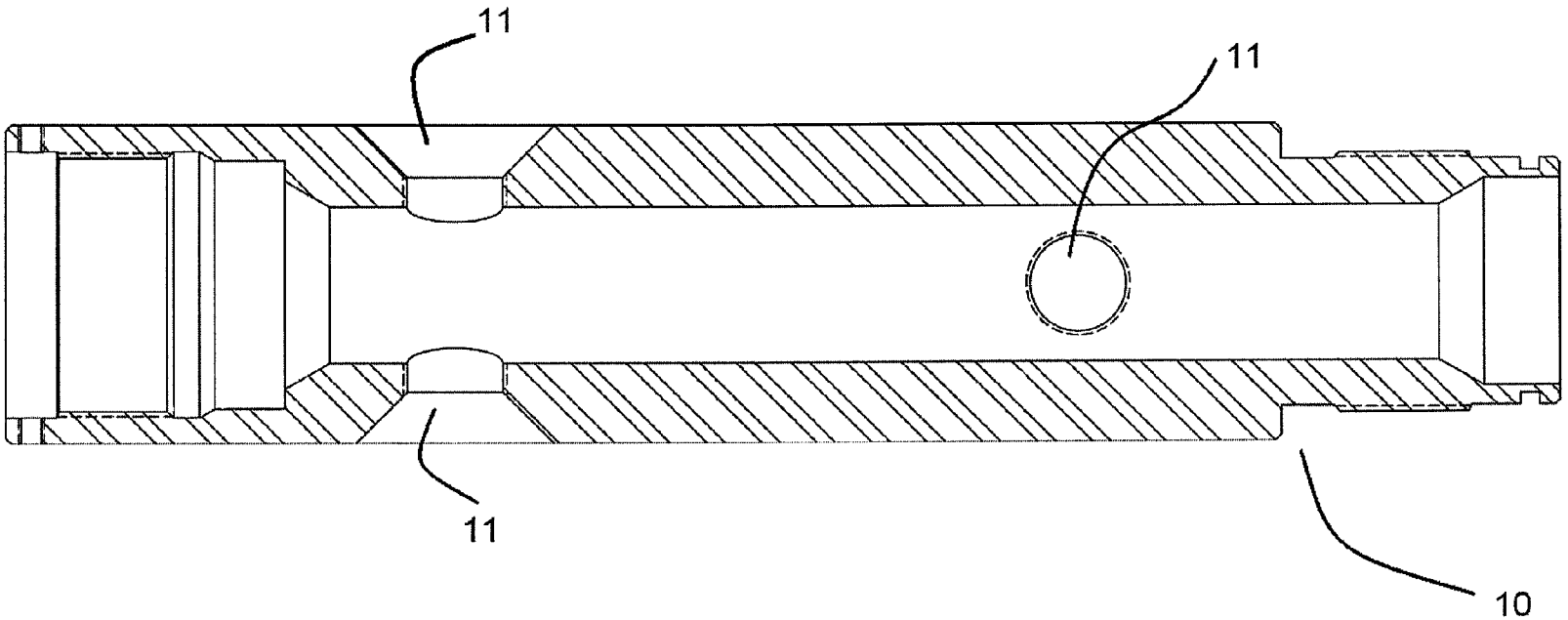
FIG. 2 is a cross sectional view of a jet perforation device in accordance with one embodiment.

In a typical jet perforation assembly 10, nozzles 11 are typically inserts fixed within the perforation mandrel, the nozzles having engineered apertures that allowing pressurized fluid to escape at high velocities. As shown in FIG. 2, jet nozzles 11 are arranged about the perforation mandrel as desired. Typically, about four nozzles is suitable, however the number of nozzles may range from one through about ten or more, depending on the length of the span of the interval to be perforated. A specific volume of abrasive fluid is delivered to the tubing string at a rate suitable for jet perforation of the casing, after which the casing may be tested or treatment initiated to confirm that suitable perforation was effected.

Once perforation is successful, the abrasive jetted fluid may be circulated from the wellbore to surface by flushing the tubing string with an alternate fluid prior to treatment application to the perforations (if desired). During treatment of the perforations by application of fluid to the wellbore annulus 82, a second volume of fluid (which may be a second volume of the treatment fluid, a clear fluid, or any other suitable fluid) may also be pumped down the tubing string to the jet nozzles to avoid collapse of the tubing string and prevent clogging of the jet nozzles.

Alternatively, treatment down the wellbore annulus may be possible without simultaneous delivery of fluid down the tubing string. For example, if the jet nozzles can be closed, the tubing string could be pressurized with fluid to avoid collapse during treatment down the annulus. Other methods for treatment of the perforations using the presently described tool string (with or without modification) are possible, using the knowledge and experience typical of operators in this field of art.

Sealing Device

As shown in the embodiment illustrated in FIG. 1, the sealing device 30 is typically positioned downhole of the fluid jetting assembly 10. This configuration allows the seal to be set against the casing in advance of perforation, if desired, and to remain set until treatment of the perforated interval is complete. Alternatively, the seal may be located anywhere along the tool assembly, and the tool string may re-positioned after perforation is complete prior to setting the sealing device below the perforations for treatment.

Suitable sealing devices will permit isolation of the most recently perforated interval from previously treated portions of the wellbore below. For example, inflatable packers, compressible packers, bridge plugs, friction cups, straddle packers, and others known in the art may be useful for this purpose. It is preferable that the sealing device forms a hydraulic seal against the casing to allow pressure testing of the sealing element prior to treatment, and to enable reliable monitoring of the treatment application pressure and bottomhole pressure during treatment. The significance of this monitoring will be explained below.

Using a configuration in which a single sealing device is positioned below the jetting device, perforation and treatment of precise locations along a vertical or deviated wellbore may be accomplished by incorporation of a depth locating device within the assembly. Notably, a mechanical casing collar locator permits precise setting of the sealing device in advance of perforation, and maintains the position of the assembly during perforation and treatment. This location ability, particularly in combination with coiled tubing deployment, overcomes positional difficulties commonly encountered with other perforation and treatment systems.

The sealing device therefore serves to maintain the position of the tool assembly downhole, and ensure the perforated wellbore is hydraulically isolated from the previously treated portion of the wellbore below. The sealing device shown in the drawings is a mechanically actuated resettable packer. Other suitable sealing devices may be used in substitution.

When the sealing device is set against the casing prior to perforation, this may assist in maintaining the position and orientation of the tool string during perforation and treatment of the wellbore. Alternatively, the sealing assembly may be actuated following perforation. In either case, the sealing assembly is set against the casing beneath the perforated interval of interest, to hydraulically isolate the lower wellbore (which may have been previously perforated and treated) from the interval to be treated. That is, the seal defines the lower limit of the wellbore interval to be treated. Typically, this lower limit will be downhole of the most recently formed perforations, but uphole of previously treated perforations. Such configuration will enable treatment fluid to be delivered to the most recently formed perforations by application of said treatment fluid to the wellbore annulus 82 from surface.

As shown in FIG. 5, the sealing assembly 30 is mechanically actuated, including a compressible packing element 31 for providing a hydraulic seal between the tool string and casing when actuated, and slips 32 for engaging the casing to set the compressible packing element 31. In the embodiment shown in FIGS. 5 through 6*c*, the mechanism for setting the sealing assembly involves a stationary pin 33 sliding within a J profile 34 formed about the sealing assembly mandrel 35. The pin 33 is held in place against the bottom sub mandrel by a two-piece clutch ring 36, and the bottom sub mandrel 50 slides over the sealing assembly mandrel 35, which bears the J profile. The clutch ring has debris relief openings 37 for allowing passage of fluid and solids during sliding of the pin 33 within the J profile 34.

Various J profiles suitable for actuating mechanical set packers and other downhole tools are known within the art. One suitable J profile 34 is shown in FIG. 6*b*, having three sequential positions that are repeated about the mandrel. Debris relief apertures 38 are present at various locations within the J-profile to permit discharge of settled solids as the pin 33 slides within the J profile. The J slots 34 are also deeper than would generally be required based on the pin length alone, which further provides accommodation for debris accumulation and relief without inhibiting actuation of the sealing device.

With reference to the J profile shown in FIG. 6*b*, three pin stop positions are shown, namely a compression set position 39*a*, a seal release position 39*b*, and a running-in position 39*c*. The sealing assembly mandrel 35 is coupled to the pull tube 49, which is slidable with respect to the bottom sub mandrel 50 that holds the pin 33. The bottom sub mandrel 50 also bears mechanical slips 51 for engaging the casing to provide resistance against sliding movement of the sealing assembly mandrel 35, such that the pin 33 slides within the J profile 34 as the pull tube (and sealing assembly mandrel) is manipulated from surface.

Equalization Valve

In order to equalize pressure across the sealing device and permit unsetting of the compressible packing element under various circumstances, an equalization valve 40 is present within the tool assembly. While prior devices may include a valve for equalizing pressure across the packer, such equalization is typically enabled in one direction only, for example from the wellbore segment below the sealing device to the wellbore annulus above the sealing device. The presently described equalization valve permits constant fluid communication between the tubing string and wellbore annulus, and, when the valve is in fully open position, also with the portion of the wellbore beneath the sealing device. Moreover, fluid and solids may pass in forward or reverse direction between these three compartments. Accordingly, appropriate manipulation of these circulation pathways allows flushing of the assembly, preventing settling of solids against or within the assembly. Should a blockage occur, further manipulation of the assembly and appropriate fluid selection will allow forward or reverse circulation to the perforations to clear the blockage.

Figure 4A:
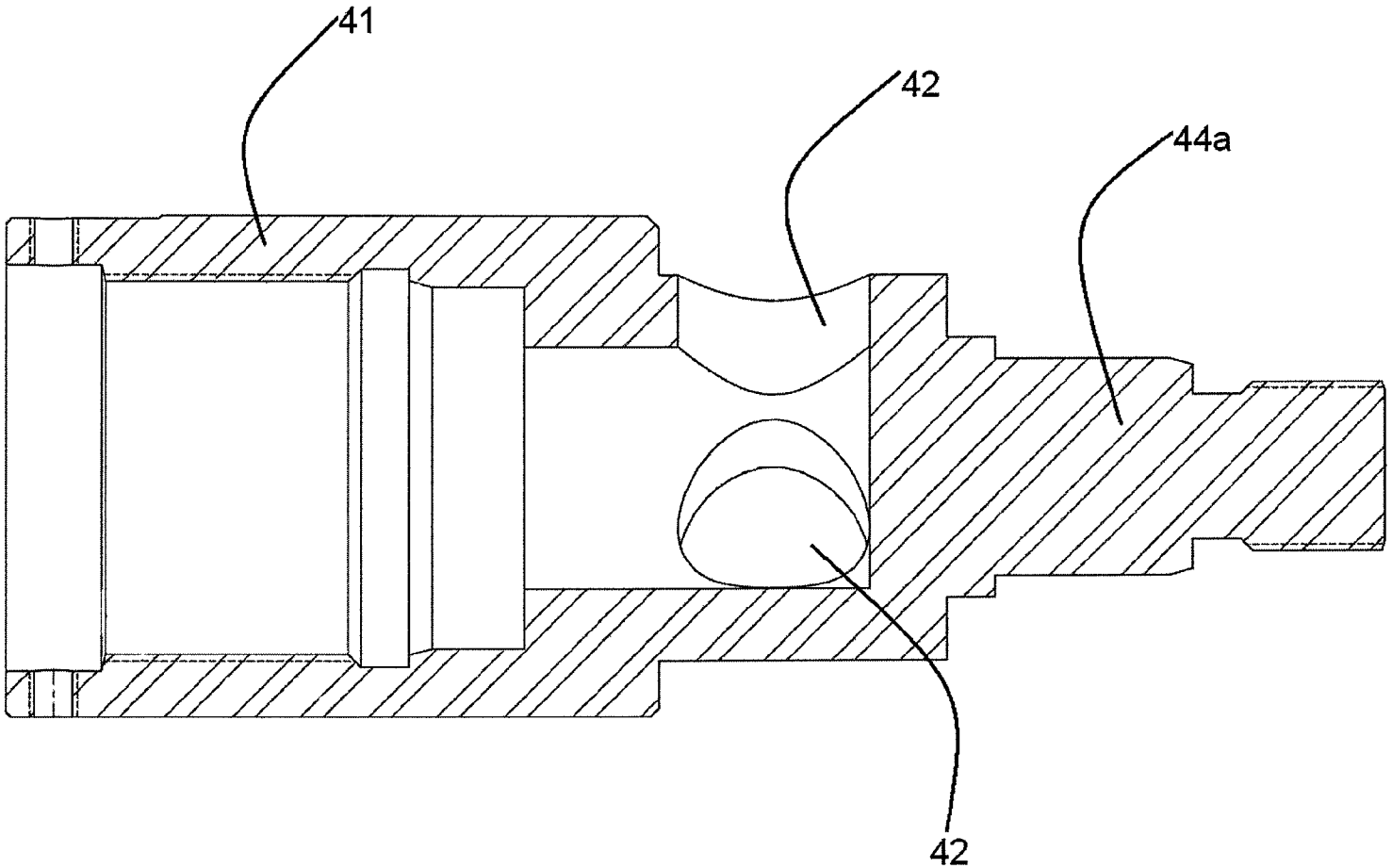
Figure 4B:
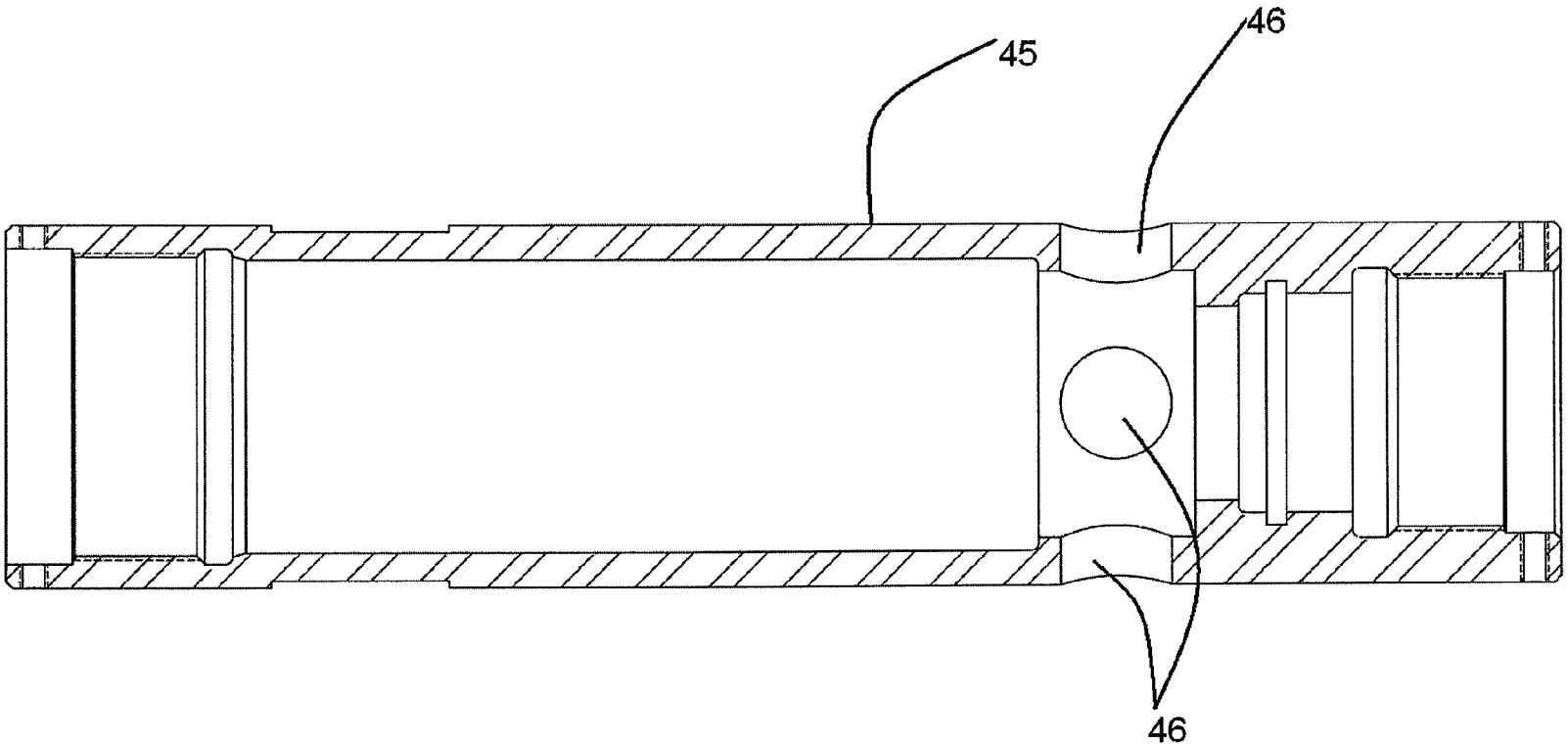

As shown in FIG. 3, the present equalization valve is operated by sliding movement of an equalization plug 41 within a valve housing 45 (FIGS. 4*a* and 4*b*). Such slidable movement is actuated from surface by pulling or pushing on the coiled tubing, which is anchored to the assembly by a main pull tube 49. The main pull tube is generally cylindrical and contains a ball and seat valve to prevent backflow of fluids through from the equalization valve to the tubing string during application of fluid through the jet nozzles (located upstream of the pull tube). The equalization plug 41 is anchored over the pull tube 49, forming an upper shoulder 41*a* that limits the extent of travel of the equalization plug 41 within the valve housing 45. Specifically, an upper lock nut 43 is attached to the valve housing 45 and seals against the outer surface of the pull tube 49, defining a stop 43*a* for abutment against the upper shoulder 41*a* of the equalization plug.

The lower end of the valve housing 45 is anchored over assembly mandrel 60, defining a lowermost limit to which the equalization plug 41 may travel within the valve housing 45. It should be noted that the equalization plug bears a hollow cylindrical core that extends from the upper end of the equalization plug 41 to the inner ports 42. That is, the equalization plug 41 is closed at its lower end beneath the inner ports, forming a profiled solid cylindrical plug 44*a* overlaid with a bonded seal 44*b*. The solid plug end 44*a* and bonded seal 44*b* are sized to engage the inner diameter of the lower tool mandrel 60, preventing fluid communication between wellbore annulus/tubing string and the lower wellbore when the equalization plug 41 has reached the lower limit of travel and the sealing device (downhole of the equalization valve) is set against the casing.

The engagement of the bonded seal 44*b* within the mandrel 60 is sufficient to prevent fluid passage, but may be removed to open the mandrel by applying sufficient pull force to the coiled tubing. This pull force is less than the pull force required to unset the sealing device, as will be discussed below. Accordingly, the equalization valve may be opened by application of pulling force to the tubing string while the sealing device remains set against the wellbore casing.

With respect to debris relief, when the sealing device is set against the wellbore casing with the equalization plug 41 in the sealed, or lowermost, position, the inner ports 42 and outer ports 46 are aligned. This alignment provides two potential circulation flowpaths from surface to the perforations, which may be manipulated from surface as will be described. That is, fluid may be circulated to the perforations by flushing the wellbore annulus alone. During this flushing, a sufficient fluid volume is also delivered through the tubing string to maintain the ball valve within the pull tube in seated position, to prevent collapse of the tubing, and to prevent clogging of the jet nozzles.

Should reverse circulation be required, fluid delivery down the tubing string is terminated, while delivery of fluid to the wellbore annulus continues. As the jet nozzles are of insufficient diameter to receive significant amounts of fluid from the annulus, fluid will instead circulate through the aligned equalization ports, unseating the ball within the pull tube, and thereby providing a return fluid flowpath to surface through the tubing string. Accordingly, the wellbore annulus may be flushed by forward or reverse circulation when the sealing device is actuated and the equalization plug is in the lowermost position.

When the sealing device is to be released (after flushing of the annulus, if necessary to remove solids or other debris), a pulling force is applied to the tubing string to unseat the cylindrical plug 44*a* and bonded seal 44*b* from within the lower mandrel 60. This will allow equalization of pressure beneath and above the seal, allowing it to be unset and moved up-hole to the next interval.

Components may be duplicated within the assembly, and spaced apart as desired, for example by connecting one or more blast joints within the assembly. This spacing may be used to protect the tool assembly components from abrasive damage downhole, such as when solids are expelled from the perforations following pressurized treatment. For example, the perforating device may be spaced above the equalizing valve and sealing device using blast joints such that the blast joints receive the initial abrasive fluid expelled from the perforations as treatment is terminated and the tool is pulled uphole.

The equalization valve therefore serves as a multi-function valve, and may be incorporated into various types of downhole assemblies, and manipulated to effect various functions, as required. That is, the equalization valve may be placed within any tubing-deployed assembly and positioned within the assembly to provide selective reverse circulation capability, and to aid in equalizing pressures between wellbore annulus segments, and with the tubing string flowpath to surface. When the equalization plug is in the sealed, or lowermost position, forward or reverse circulation may be effected by manipulation of fluids applied to the tubing string and/or wellbore annulus from surface. The equalization plug may be unset from the sealed position to allow fluid flow to/from the lower tool mandrel, continuous with the tubing string upon which the assembly is deployed. When the equalization plug is associated with a sealing device, this action will allow pressure equalization across the sealing device.

Notably, using the presently described valve and suitable variants, fluid may be circulated through the valve housing when the equalization valve is in any position, providing constant flow through the valve housing to prevent clogging with debris. Accordingly, the equalization valve may be particularly useful when incorporated into downhole assemblies deployed in sand-laden environments.

It is noted that the presently described equalization plug may be machined to any suitable configuration that will provide a valve stem for seating within the lower assembly mandrel, and which is actuable from surface without impeding flow from the outer ports 46 of the valve housing 45 to the ball valve. By similar logic, the ball valve may be replaced with any suitable check valve/one way valve.

In the embodiment shown in the drawings, it is advantageous that the pull tube actuates both the equalization plug and the J mechanism, at varying forces to allow selective actuation. However, other mechanisms for providing this functionality may now be apparent to those skilled in this art field and are within the scope of the present teaching.

Further Debris Relief Features

The present J profile bears debris relief apertures 38 to allow clearance of solid particles from the J slot that may otherwise complicate setting and unsetting of the packer. The relative proportions of the pin and slot include sufficient clearance (for example V16 or ⅛ inch clearance) in both depth and width to permit sliding of pin in the slot when a certain amount of debris is present, enabling the sand to be driven along the slot and through the apertures 38 by the pin during actuation of the packer by application of force from surface. The number and shape of the apertures may vary depending on the environment in which the tool is used. For example, if a significant amount of debris is expected to contact the J slot, the slot may instead include a narrow opening along the entire base of the slot to allow continuous debris movement through the J slot.

A mechanical casing collar locator (MCCL) is incorporated into the particular tool string that is shown in the Figures. When this type of locating device is present within a tool string, the fingers 61 of the locator are typically biased outwardly so as to slide against the casing as the assembly is moved within the wellbore. As shown in FIG. 7, the MCCL mandrel 60 of the present assembly includes fingers 61 that are biased (for example using resilient element 62) outwardly so as to engage the casing as the assembly is moved along the wellbore. As shown, each finger 61 is held within a cavity against the resilient element 62 by a retention sleeve 64 threaded over the MCCL mandrel 60. A narrow slot 63 extends longitudinally within each cavity over which the resilient element is placed, to allow fluid communication between the cavity and the tubing string. Further, another slot within the outer surface of the mandrel extends across each cavity such that fluid may enter each cavity from the wellbore annulus. Once assembled, a fluid flowpath extends between the wellbore annulus 82, to the cavity beneath each finger 61, and through the cavity to the tubing string. Accordingly, this permits flushing of fluid past the fingers during operation. This open design minimizes the risk of debris accumulation adjacent the resilient element, which may force the fingers to remain extended against the casing or within a casing joint.

Detection of Adverse Events

During the application of treatment to the perforations via the wellbore annulus, the formation may stop taking up fluid, and the sand suspended within the fracturing fluid may settle within the fracture, at the perforation, on the packer, and/or against the tool assembly. As further circulation of proppant-laden fluid down the annulus will cause further undesirable solids accumulation, early notification of such an event is important for successful clearing of the annulus and, ultimately, removal of the tool string from the wellbore.

During treatment of the perforations down the wellbore annulus using the tool string shown in the Figures, fluid will typically be delivered down the tubing string at a constant (minimal) rate to maintain pressure within the tubing string and keep the jet nozzles clear. The pressure required to maintain this fluid delivery may be monitored from surface. The pressure during delivery of treatment fluid to the perforations via the wellbore annulus is likewise monitored. Accordingly, the tubing string may be used as a "dead leg" to accurately calculate (estimate/determine) the fracture extension pressure by eliminating the pressure that is otherwise lost to friction during treatment applied to the wellbore. By understanding the fracture extension pressure trend (also referred to as stimulation extension pressure), early detection of solids accumulation at the perforations is possible. That is, the operator will quickly recognize a failure of the formation to take up further treatment fluid by comparing the pressure trend during delivery of treatment fluid down the wellbore annulus with the pressure trend during delivery of fluid down the tubing string. Early recognition of an inconsistency will allow early intervention to prevent debris accumulation at the perforations and about the tool.

During treatment, a desired volume of fluid is delivered to the formation through the most recently perforated interval, while the remainder of the wellbore below the interval (which may have been previously perforated and treated) is hydraulically isolated from the treatment interval. Should the treatment be successfully delivered down the annulus successfully, the sealing device may be unset by pulling the equalization plug from the lower mandrel. This will equalize pressure between the wellbore annulus and the wellbore beneath the seal. Further pulling force on the tubing string will unset the packer by sliding of the pin 33 to the unset position 39*b* in the J profile. The assembly may then be moved uphole to perforate and treat another interval.

However, should treatment monitoring suggest that fluid is not being successfully delivered, indicating that solids may be settling within the annulus, various steps may be taken to clear the settled solids from the annulus. For example, pumping rate, viscosity, or composition of the annulus treatment fluid may be altered to circulate solids to surface.

Should the above clearing methods be unsuccessful in correcting the situation (for example if the interval of interest is located a great distance downhole that prevents sufficient circulation rates/pressures at the perforations to clear solids), the operator may initiate a reverse circulation cycle as described above. That is, flow downhole through the tubing string may be terminated to allow annulus fluid to enter the tool string through the equalization ports, unseating the ball valve and allowing upward flow through the tubing string to surface. During such reverse circulation, the equalizer valve remains closed to the annulus beneath the sealing assembly.

Method

A method for deploying and using the above-described tool assembly, and similar functioning tool assemblies, is provided. The method includes at least the following steps, which may be performed in any logical order based on the particular configuration of tool assembly used:

- running a tool string downhole to a predetermined depth, the tool string including a hydra-jet perforating assembly and a packer assembly below the perforating assembly
- setting the packer assembly against the wellbore casing
- creating perforations in the casing by jetting fluid from nozzles within the perforating assembly
- pumping a treatment fluid down the wellbore annulus from surface under pressure, while simultaneously pumping fluid down the tubing string and through the jet nozzles; and
- monitoring fracture extension pressure during treatment.

In addition, any or all of the following additional steps may be performed:

- reverse circulating annulus fluid to surface through the tubing string
- equalizing pressure above and below the sealing device
- equalizing pressure between the tubing string and wellbore annulus without unseating same from the casing
- unseating the sealing assembly from the casing
- repeating any or all of the above steps within the same wellbore interval
- moving the tool string to another predetermined interval within the same wellbore and repeating any or all of the above steps A method of providing a reverse circulation pathway within a downhole assembly is described. This method is particularly useful in sand-laden environments, where debris accumulation may require alternate circulation flowpaths. With reference to FIGS. 3, 4*a*, and 4*b*, an equalization valve 40 is provided, associated with a ball and seat valve or similar device for diverting fluid from the tubing string during normal operation of the assembly, i.e. when reverse circulation is not required. That is, delivery of fluid to the tubing string from surface will force the ball into its seat, and prevent direct fluid communication from the tubing string to the equalization valve. The equalization valve is, however, in indirect fluid communication with the tubing string, as fluid diverted from the tubing string into the wellbore annulus flows through outer ports 46 of the valve housing to bathe/flush the equalization plug 41 and inner surfaces of the valve housing 45. As the equalization plug 41 also includes inner ports 42, fluid may flow through outer ports 46 and inner ports 42, whether or not said ports are aligned. Accordingly, the equalization valve is continually washed with wellbore annulus fluid, assisting circulation downhole and preventing settling or accumulation of solids against the tool or within the valve.

Typically, the equalization plug will be slidable within the valve housing between a sealed position—in which the cylindrical plug 44*a* and bonded seal 44*b* are engaged within the lower mandrel, with inner and outer ports 42, 46 aligned as discussed above—and an unsealed position. The plug is operatively attached to a pull tube 49, which may be actuated from surface to control the position of the equalization plug 41 within the valve housing 45.

Should a blockage occur downhole, for example above a sealing device within the assembly, delivery of fluid through the tubing string at rates and pressures sufficient to clear the blockage may not be possible, and likewise, delivery of clear fluid to the wellbore annulus may not dislodge the debris. Accordingly, in such situations, reverse circulation may be effected while the inner and outer ports remain aligned, simply by manipulating the type and rate of fluid delivered to the tubing string and wellbore annulus from surface. Where the hydraulic pressure within the wellbore annulus exceeds the hydraulic pressure down the tubing string (for example when fluid delivery to the tubing string ceases), fluid within the equalization valve will force the ball to unseat, providing reverse circulation to surface through the tubing string, carrying flowable solids.

Further, the plug may be removed from the lower mandrel by application of force to the pull tube (by pulling on the tubing string from surface). In this unseated position, a further flowpath is opened from the lower tool mandrel to the inner valve housing (and thereby to the tubing string and wellbore annulus). Where a sealing device is present beneath the equalization device, pressure across the sealing device will be equalized allowing unsetting of the sealing device.

It should be noted that the fluid flowpath from outer ports 46 to the tubing string is available in any position of the equalization plug. That is, this flowpath is only blocked when the ball is set within the seat based on fluid down tubing string. When the equalization plug is in its lowermost position, the inner and outer ports are aligned to permit flow into and out of the equalization valve, but fluid cannot pass down through the lower assembly mandrel. When the equalization plug is in the unsealed position, the inner and outer ports are not aligned, but fluid may still pass through each set of ports, into and out of the equalization valve. Fluid may also pass to and from the lower assembly mandrel. In either position, when the pressure beneath the ball valve is sufficient to unseat the ball, fluid may also flow upward through the tubing string.

The above-described embodiments of the present invention are intended to be examples only. Each of the features, elements, and steps of the above-described embodiments may be combined in any suitable manner in accordance with the general spirit of the teachings provided herein. Alterations, modifications and variations may be effected by those of skill in the art without departing from the scope of the invention, which is defined solely by the claims appended hereto.

What is claimed is:

1. An assembly for treating an interval of a wellbore, composing:

a fluid jet perforation device, deployed on a tubing string;

a resettable sealing device deployed on the tubing string in fluid communication with the fluid jet perforation device;

the sealing device including a J-profile with a pin slidably-disposed in said J-profile for use in actuation of the sealing device wherein the J-profile comprises one or more debris discharge ports through the J-profile to permit discharge of the debris upon slidable movement of the pin within the J-profile.

2. The assembly as in claim 1, further comprising a mechanical casing collar locator having outwardly biased locating members slidable against the cased wellbore to verify a downhole location of the assembly prior to actuation of the resettable sealing device.

3. The assembly as in claim 2, wherein the mechanical casing collar locator comprises a cavity beneath the outwardly biased locating members, for allowing passage of fluid and debris through the mechanical casing collar locator to the tubing string.

4. The assembly as in claim 1, wherein the pin is actuated by application of mechanical force to the tubing string.

5. The assembly as in claim 1 , wherein the J-profile is sized at least 1/16 inch greater than a diameter of the pin to allow debris accumulation and movement within the J-profile without impeding travel of the pin along the J-profile.

6. The assembly as in claim 1, wherein the fluid jet perforation device is assembled above the resettable sealing device.

7. A method for abrasive perforation and treatment of a formation intersected by a cased wellbore, the method comprising the steps of:

providing a tool assembly comprising a fluid jet perforation device, and a sealing device comprising a J-profile with a pin for use in actuation of the sealing device;

deploying the tool assembly on a tubing string within the cased wellbore:

setting the sealing device against the cased wellbore;

while the sealing device is set against the cased wellbore; jetting abrasive fluid from the fluid jet perforation device to perforate the cased wellbore for forming one or more perforations;

while the sealing device remains set against the cased wellbore, circulating treatment fluid down an annulus formed by the cased wellbore to treat the one or more perforations;

circulating the treatment fluid from the annulus;

delivering abrasive fluid to the tubing string while delivering the treatment fluid down the annulus; and, unsetting the sealing device from the cased wellbore.

8. The method as in claim 7, further comprising actuating the sealing device by application of mechanical force to the tubing string.

9. The method as in claim 7, wherein the abrasive fluid comprises sand.

10. The method as in claim 7, wherein the treatment fluid comprises flowable solids.

11. The method as in claim 7, further comprising the step of equalizing pressure above and below the sealing device by applying a force to the tubing string to actuate an equalization valve.

12. The method as in claim 7, further comprising the step of equalizing pressure between the tubing string and the annulus without unseating the sealing device from the cased wellbore.

13. The method as in claim 7, further comprising the step of moving the tool assembly to another interval within the wellbore and repeating one or more of the steps recited in claim 7.

14. The method as in claim 7, further comprising the step of providing a valve assembly between the fluid jet perforation device and the sealing device.

15. An assembly for treating an interval of a wellbore, comprising:

a fluid jet perforation device, deployed on a tubing string;

a resettable sealing device deployed on the tubing string in fluid communication with the fluid jet perforation device;

the sealing device including a J-profile with a pin slidably-disposed in said J-profile for use in actuation of the sealing device wherein the pin is held to the assembly by a clutch ring, and wherein the clutch ring comprises an aperture to permit discharge of the debris from about the pin while the pin slides within the J-profile.

16. An assembly for eating an interval of a wellbore, comprising:

a fluid jet perforation device, deployed on a tubing string;

a resettable sealing device deployed on the tubing string in fluid communication with the fluid jet perforation device;

the sealing device including a J-profile with a pin slidably-disposed in said J-profile for use in actuation of the sealing device an equalization valve for actuating slidable movement of the sliding pin within the resettable sealing device wherein the equalization valve comprises;

an equalization valve plug slidably disposed within an equalization valve housing continuous with the resettable sealing device for actuating slidable movement of the pin within the J-profile.

17. The assembly as in claim 16, wherein the equalization plug is slidably actuated by application of mechanical force to the tubing string to set or unset the resettable sealing device within the wellbore.

18. A method for abrasive perforation and treatment of a formation intersected by a cased wellbore, the method comprising the steps of:

providing a tool assembly comprising
a fluid jet perforation device, and
a sealing device comprising a J-profile with a pin for use in actuation of the sealing device;

deploying the tool assembly on a tubing string within the cased wellbore;

setting the sealing device against the cased wellbore;

while the sealing device is set against the cased wellbore; jetting abrasive fluid from the fluid jet perforation device to perforate the cased wellbore for forming one or more perforations;

while the sealing device remains set against the cased wellbore, circulating treatment fluid down an annulus formed by the cased wellbore to treat the one or more perforations;

circulating the treatment fluid from the annulus;

monitoring pressure of the abrasive fluid within the tubing string;

monitoring a rate and pressure of the treatment fluid delivered down the annulus;

estimating a fracture extension pressure during treatment of the cased wellbore; and unsetting the sealing device from the cased wellbore.

19. A method for abrasive perforation and treatment of a formation intersected by a cased wellbore, the method comprising the steps of:

providing a tool assembly comprising
a fluid jet perforation device, and
a sealing device comprising a J-profile with a pin for use in actuation of the sealing device;

deploying the tool assembly on a tubing string within the cased wellbore;

setting the sealing device against the cased wellbore;

while the sealing device is set against the cased wellbore; jetting abrasive fluid from the fluid jet perforation device to perforate the cased wellbore for forming one or more perforations;

while the sealing device remains set against the cased wellbore, circulating treatment fluid down an annulus formed by the cased wellbore to treat the one or more perforations;

circulating the treatment fluid from the annulus;

reverse circulating the treatment fluid from the annulus to surface through the tubing string; and unsetting the sealing device from the cased wellbore.

20. The method as in claim 19, wherein the sealing device remains set against the cased wellbore during reverse circulation.

21. The method as in claim 19, wherein the treatment fluid comprises flowable solids, and wherein the flowable solids are circulated to surface through the J-profile.

22. A method for abrasive perforation and treatment of a formation intersected by a cased wellbore, the method comprising the steps of:

providing a tool assembly comprising
a fluid jet perforation device, and
a sealing device comprising a J-profile with a pin for use in actuation of the sealing device;

deploying the tool assembly on a tubing string within the cased wellbore;

setting the sealing device against the cased wellbore;

while the sealing device is set against the cased wellbore; jetting abrasive fluid from the fluid jet perforation device to perforate the cased wellbore for forming one or more perforations;

while the sealing device remains set against the cased wellbore, circulating treatment fluid down an annulus formed by the cased wellbore to treat the one or more perforations;

circulating the treatment fluid from the annulus;

opening an equalization passage extending through the sealing device to permit fluid communication of a first portion of the annulus beneath the sealing device to a second portion of the annulus above the sealing device; and, unsetting the sealing device from the cased wellbore.

* * * * *